US006755397B2

(12) United States Patent
Nonaka

(10) Patent No.: US 6,755,397 B2
(45) **Date of Patent: *Jun. 29, 2004**

(54) DIAPHRAGM-TYPE CARBURETOR

(75) Inventor: Takumi Nonaka, Iwate-ken (JP)

(73) Assignee: Zama Japan (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/446,918

(22) Filed: May 27, 2003

(65) Prior Publication Data

US 2003/0201551 A1 Oct. 30, 2003

Related U.S. Application Data

(63) Continuation of application No. 10/094,263, filed on Mar. 8, 2002, now Pat. No. 6,631,889.

(30) Foreign Application Priority Data

Mar. 8, 2001 (JP) ..... 2001-064448

(51) Int. Cl.[7] ..... F02M 7/22

(52) U.S. Cl. ..... 261/35; 261/51; 261/60; 261/DIG. 38

(58) Field of Search ..... 261/35, 51, 60, 261/50.1, 50.2, DIG. 38, DIG. 39

(56) References Cited

U.S. PATENT DOCUMENTS

| | | | | |
|---|---|---|---|---|
| 2,595,720 A | | 5/1952 | Snyder | 261/50.2 |
| 2,986,381 A | | 5/1961 | Jones | 261/41.1 |
| 3,013,779 A | | 12/1961 | Kalert, Jr. et al. | 261/51 X |
| 3,215,413 A | * | 11/1965 | Szwargulski et al. | 261/41.5 |
| 3,559,963 A | | 2/1971 | Cedarholm | 261/50.1 |
| 3,680,846 A | | 8/1972 | Bickhaus et al. | 261/51 |
| 4,177,225 A | | 12/1979 | Berkbigler | 261/50.2 |
| 4,481,152 A | | 11/1984 | Kobayashi et al. | 261/35 |
| 5,537,979 A | | 7/1996 | Nuti | 123/438 |
| 6,394,424 B2 | | 5/2002 | Pattullo et al. | 261/35 |

FOREIGN PATENT DOCUMENTS

| | | |
|---|---|---|
| JP | 49-17682 | 5/1974 |
| JP | 55-69748 | 5/1980 |
| JP | 58-101253 | 6/1983 |

* cited by examiner

*Primary Examiner*—Richard L. Chiesa
(74) *Attorney, Agent, or Firm*—Orrick, Herrington & Sutcliffe LLP

(57) ABSTRACT

The present invention facilitates increased output, decreased size, and simplified design and manufacture for a carburetor system in which a metering pin, which moves on a throttle valve, controls the fuel flow rate for a single fuel system. A carburetor of the present invention includes a butterfly-like throttle valve on an air intake pathway with a nearly uniform diameter along its entire length, and a fuel nozzle positioned on the downstream side thereof. A metering pin retained by an actuating member that reciprocates linearly and remains in constant contact with a cam face of a cam member located on a valve stem. Fuel supplied to the air intake pathway from a constant fuel chamber via the fuel nozzle is controlled according to the opening and closing of a throttle. The metering pin by means of a cam controls the volume of the fuel flow rate at a desired stroke set irrespective of the opening and closing movement of the throttle valve.

31 Claims, 3 Drawing Sheets

DIAPHRAGM-TYPE CARBURETOR

CROSS REFERENCE TO RELATED APPLICATION

This application is a continuation of application Ser. No. 10/094,263, which was filed on Mar. 8, 2002 and issued as U.S. Pat. No. 6,631,889, and which is fully and expressly incorporated herein by reference.

FIELD OF THE INVENTION

The invention primarily relates to a diaphragm-type carburetor for supplying fuel to general-purpose engines and, more particularly, relates to a diaphragm-type carburetor comprising a butterfly-type throttle valve and a single fuel nozzle that allows fuel measured in accordance with the opening or closing of the throttle valve to be sent from the fuel nozzle.

BACKGROUND OF THE INVENTION

Two- and four-cycle general-purpose engines are small in size, and small diaphragm-type carburetors are often used to supply fuel thereto. Examples of commonly known diaphragm-type carburetors are the fixed venturi model discussed in Japanese Kokai S55-69748, which comprises a butterfly-type throttle valve and two fuel systems, a low-speed system and a main system; the variable venturi model presented in Japanese examined utility model application No. S49-17682, which comprises a single fuel system capable of supplying a variable amount of fuel by means of a cylindrical sliding throttle valve and a metering pin attached to the sliding throttle; and the carburetor described in Japanese Kokai S58-101253, which comprises a single fuel system capable of supplying a variable amount of fuel by means of a cylindrical rotary throttle valve and a metering pin attached to the rotary throttle valve.

The control of the fuel supply by the metering pin in response to axial movement of the sliding or rotary throttle valve in the single fuel system models is beneficial in that it requires no special consideration for fuel-related connections and, unlike the models with two fuel systems, includes a simple pathway structure. In addition, the cross sectional area of the sliding or rotary throttle valve, when fully open, is identical to that of the air intake pathway, thus beneficially allowing such models to more easily supply the required volume of air at times of high output than the fixed venturi model.

The sliding valve linearly reciprocates along a length nearly identical to the diameter of the air intake pathway. As a result, a spacing of a size at least equivalent to the stroke of the sliding throttle valve must be provided between a constant fuel chamber, which contains a constant amount of fuel by means of a diaphragm, and the opening of the fuel nozzle to the air intake pathway in order to accommodate a metering pin that operates integrally with the sliding throttle valve. For this reason, the air intake pathway cannot be made sufficiently small. As far as the rotary throttle valve, it moves slightly in the central axial direction as it rotates so that a metering pin that moves integrally with the rotating throttle valve can control the amount of fuel supplied. Because minute movements of the metering pin control the required fuel amounts for all operating levels of the engine, the dimensional and positional relationships between the fuel nozzle and the metering pin have to be set with a high degree of accuracy, which poses design and manufacturing problems.

SUMMARY OF THE INVENTION

The present invention was created in order to solve the above problems of the fixed venturi, sliding throttle valve, and rotary throttle diaphragm-type carburetors—including those problems related to a transition to high output, fuel-related connections, miniaturization of the carburetor, and design and construction simplicity. A primary object of the present invention is to provide a diaphragm-type carburetor that enables high output and miniaturization of the carburetor as a whole, yet poses no particular design or manufacturing problems.

In order to solve the above problems, the present invention provides a diaphragm-type carburetor comprising an air intake pathway that penetrates a body and is formed with a nearly uniform diameter along its entire length, a constant fuel chamber that is provided along one face of the body and contains a constant amount of fuel by means of a diaphragm, a butterfly-type throttle valve that opens and closes the air intake pathway, a fuel nozzle that is disposed on the downstream side of the throttle valve and supplies fuel introduced from the constant fuel chamber to the air intake pathway, a metering pin having a tip thereof inserted into the fuel nozzle, a cam member centered on a valve stem of the throttle valve and having an arc-shaped cam face, and an actuating member that makes constant contact with the cam face and reciprocates linearly. The metering pin, which is held by the actuating member, reciprocates linearly following the opening and closing of the throttle valve, and controls the amount of fuel supplied from the fuel nozzle to the air intake pathway.

Because the air intake pathway lacks a venturi and has a nearly uniform diameter along its entire length, it can easily provide the airflow rate required during high output. Additionally, because the throttle valve is a butterfly-type throttle valve, the valve stem length is shorter than the sliding and rotary models. This allows for miniaturization of the carburetor as a whole. Moreover, the fuel nozzle is positioned on the downstream side of the throttle valve and the fuel supply amount is controlled by the metering pin, which follows the throttle via a cam mechanism. Therefore, the required fuel rate can be controlled over an entire operating range of the engine with a single fuel system. In this case, the stroke of the metering pin may be set as desired with the cam irrespective of the throttle valve. As a result, the function of appropriately controlling the amount of fuel supplied over the entire operation range of the engine can be easily provided.

In the above embodiment of the invention, the actuating member has a contact portion that makes contact with the cam face and a retaining member for retaining the metering pin, and is supported on the body by a rotation locking means. The force of a spring acts to place the contact portion in contact with the cam face. The retaining member, which has the shape of an open-ended tube, is positioned in a region outside of the cam member. The retaining member retains the metering pin so that the insertion depth thereof into the fuel nozzle can be adjusted by an adjustment screw screwed into the interior thereof. The retaining member configuration is preferred for smooth and accurate conversion of the opening and closing motion of the throttle valve into linear reciprocating motion of the metering pin and that also for appropriate adjustment of the insertion depth of the metering pin into the fuel nozzle after assembly.

In the above embodiment of the present invention, the throttle lever—which is attached to the valve stem so that movement associated with acceleration control is transmitted to and opens or closes the throttle valve—preferably acts as a cam member as well in order to reduce the number of parts.

Further, objects and advantages of the invention will become apparent from the following detailed description and accompanying drawings.

DETAILED DESCRIPTION OF THE PREFERRED EMBODIMENT

Figure 1:
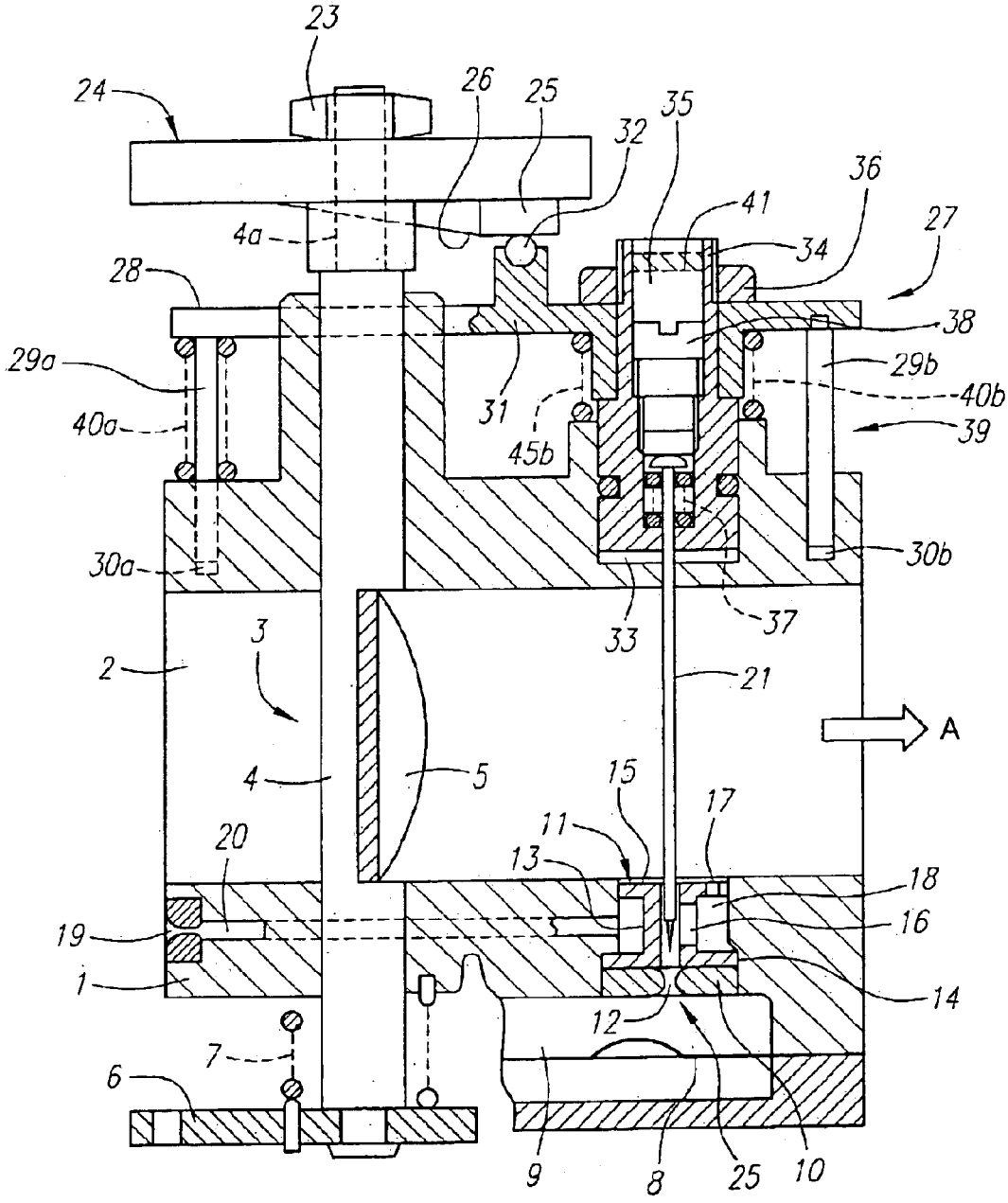
FIG. 1 is a longitudinal sectional view of the first embodiment of a carburetor of the present invention.
Figure 2:
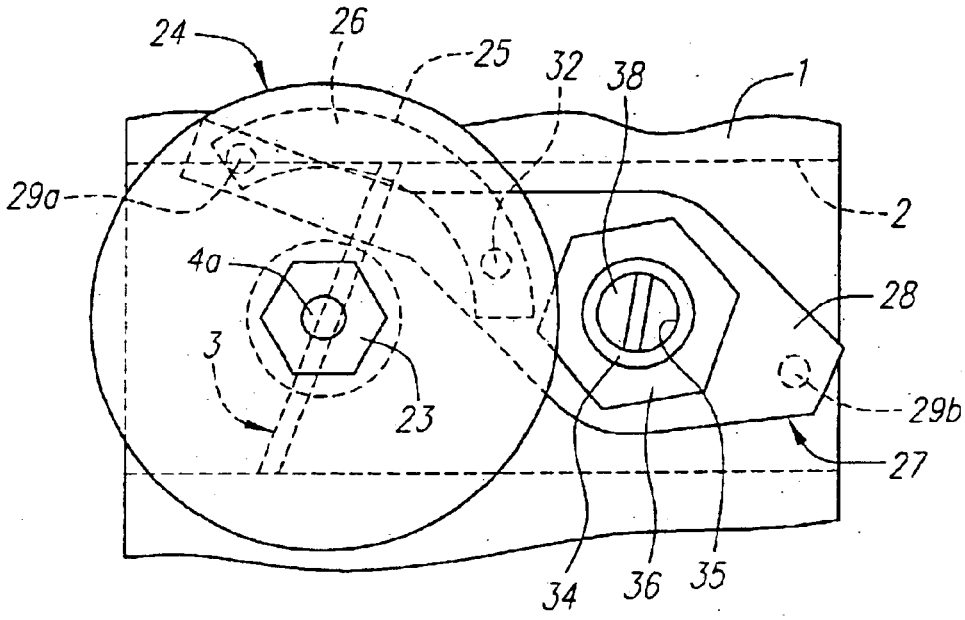
FIG. 2 is a top view of the carburetor of FIG. 1.

A preferred embodiment of the carburetor of the present invention will be discussed in reference to the drawings. In FIGS. 1 and 2, which show a first preferred embodiment of the present invention, an air intake pathway 2 with a uniform diameter is formed through a body 1, and a conventional butterfly-type throttle valve 3 comprising a valve plate 5 composed of a disk attached to a valve stem 4 is rotatably supported on the body 1. The valve stem 4 horizontally crosses the air intake pathway 2 and protrudes at both ends from the body 1. Air coming from an air cleaner (not shown) passes through the throttle valve 3 flowing in the direction of Arrow A, to supply a combustion chamber of an engine (not shown).

In this embodiment, a throttle lever 6 affixed to one end of the valve stem 4 is pulled and rotated by acceleration controls to open and close the throttle valve 3. Optimally, the throttle valve 3 can be closed under the force of a return spring 7 comprising a screw coil spring attached to the same end of the valve stem 4, which is a commonly known configuration.

An indentation formed on one face of the body 1 is covered with a diaphragm 8 to form a constant fuel chamber 9. Fuel from a fuel tank (not shown) is introduced into the constant fuel chamber 9 by a fuel pump (not shown) attached along an appropriate face of the body 1. The pump is typically a conventional pulsating diaphragm fuel pump driven under pressure pulsations generated in the crank chamber of the engine. The amount of fuel introduced is regulated by a fuel valve (not shown) that opens or closes according to changes in position of the diaphragm 8. Accordingly, the constant fuel chamber 9 always contains a constant amount of fuel.

A main jet 10 that regulates the maximum flow rate of the fuel and a fuel nozzle 11 that supplies fuel to the air intake pathway 2 are disposed adjacently between the air intake pathway 2 and the constant fuel chamber 9 of the body 1. The fuel nozzle 111 comprises a pipe 13 and a clamping flange 14 on its base end superimposed on the main jet 10. The pipe 13 comprises a hole 12 connected to the jet hole of the main jet 10. The fuel nozzle 11 also comprises a supply flange 15 at an end of the pipe 13, adjacent the air intake pathway 2, one or a plurality of nozzle ports 17 located on the supply flange 15, and a metering hole 16 that extends in the axial direction along the pipe wall of the pipe 13. A toric mixing chamber 18 is present in the outside area between the two flanges 14 and 15 of the pipe 13, and an air bleeding pathway 20 with a jet 19 that regulates air flow is connected to the mixing chamber 18.

The main jet 10 and the fuel nozzle 11 are positioned on the downstream side of the throttle valve 3. A tip of a metering pin 21, which horizontally crosses the air intake pathway 2 and is positioned parallel to the valve stem 4, is inserted in the hole 12. The metering pin 21 reciprocates linearly so as to set the metering hole 16 to the minimum aperture when the engine is idling and to the maximum aperture when the engine is at full output.

Fuel entering the hole 12 from the constant fuel chamber 9 via the main jet 10 is metered by the metering hole 16 and the metering pin 21, enters the mixing chamber 18, mixes with bled air, and is supplied to the air intake pathway 2 via the nozzle port 17. In this embodiment, the supply flange 15 provided with the nozzle port 17 is positioned on the same surface as the wall surface of the air intake pathway 2. Introduction of bled air, therefore, helps reduce the size of the fuel droplets and is effective in eliminating fuel flow along the walls.

A small-diameter component 4A is formed on the other end of the valve stem 4, opposite the throttle lever. A disc-shaped cam member 24 is joined to the small-diameter component stem 4A and secured by a nut 23 and forced to press a step-like portion. The cam member 24 comprises an arc-shaped cam 25 that is centered on the valve stem 4. A cam surface 26 thereof faces the body 1.

A planar following member 28 is positioned along the surface of the body 1 on the side where the cam member 24 is disposed. Pin-shaped legs 29A and 29B that protrude from both ends thereof are inserted into receiving holes 30A and 30B established in the body 1. Between the legs 29A and 29B, a ball is rotatably installed in an end of a platform 31 that protrudes in a direction opposite that in which the legs 29A and 29B protrude. The ball forms a contact portion 32 that makes contact with the cam face 26.

In the portion between the platform 31 of the following member 28 and the leg 29B, an open ended, tube-shaped retaining member 34 provided with a step portion having a control hole 35 is joined at its small-diameter base end to the following member 28 and is secured against the step portion by applying pressure with a nut 36. The retaining member 34 is slidably and hermetically received in a retaining hole 33 provided in the body 1. A base end of the metering pin 21, which horizontally crosses the air intake pathway 2, is inserted into the control hole 35 from the tip of the retaining member 34, and a spring 37 biases it deeply therein. A tip of an adjustment screw 38 inserted and screwed into the control hole 35 from the base end side makes contact with an end of the metering pin 21.

The following member 28 with the contact portion 32 and the retaining member 34, which retains the metering pin 21, constitute a actuating member 27 that causes the metering pin 21 to reciprocate linearly following the angular reciprocating movement of the cam member 24. The legs 29A and 29B and the receiving holes 30A and 30B constitute a rotation locking means 39 that causes the retaining member 34 to reciprocate linearly centered on the same axis as the fuel nozzle 11 and the metering pin 21, without the following member 28 being displaced under the angular reciprocating motion of the cam member 24. Pressing springs 40A and 40B sandwich the leg 29A and the retaining member 34, which sandwich the contact portion 32. The pressing springs 40A and 40B comprise pressurized coil springs that are sandwiched between the body 1 and the following member 28. The pressing springs 40A and 40B constantly press the contact portion 32 into contact with the cam face 26, cause the actuating member 27 to move parallel without tilting, and provide for accurate metering of fuel by the metering pin 21.

Once this embodiment is assembled, the depth of insertion of the metering pin 21 into the hole 12 during idling in particular (i.e., the area of the effective aperture of the metering hole 16) is adjusted as necessary by rotating the adjustment screw 38 to bring about stable idling. As FIGS. 1 and 2 clearly show, the retaining member 34 of this embodiment is arranged in a region on the outside of the cam member 24, so such adjustments can be easily made. Once adjustment is complete, a plug 41 is inserted to close the base end of the control hole 35 to prevent the engine user from moving the metering pin 21 and knocking the engine out of kilter.

The contact portion 32 comes into contact with the highest part of the cam face 26 when the engine idles, and the metering pin 21 minimizes the effective aperture area of the metering hole 16. As the throttle valve 3 begins to open, the contact portion 32 makes contact with gradually lower parts of the cam face 26, increasing the effective aperture area of the metering hole 16. When the throttle 3 is fully open, the aperture of the metering hole 16 is at maximum.

In this embodiment, the flow rate characteristic of the fuel can be set arbitrarily by the shape of the cam 25, the size and shape of the metering hole 10, and, in particular, the shape of the tip of the metering pin 21. The stroke of the metering pin 21 may be set as desired with the cam 25 irrespective of the opening and closing of the throttle valve 3, and the position of the metering pin 21 relative to the fuel nozzle 11 can be adjusted with the adjustment screw 38, thereby eliminating design and manufacturing problems and paving the way for miniaturization of the carburetor as a whole.

Figure 3:
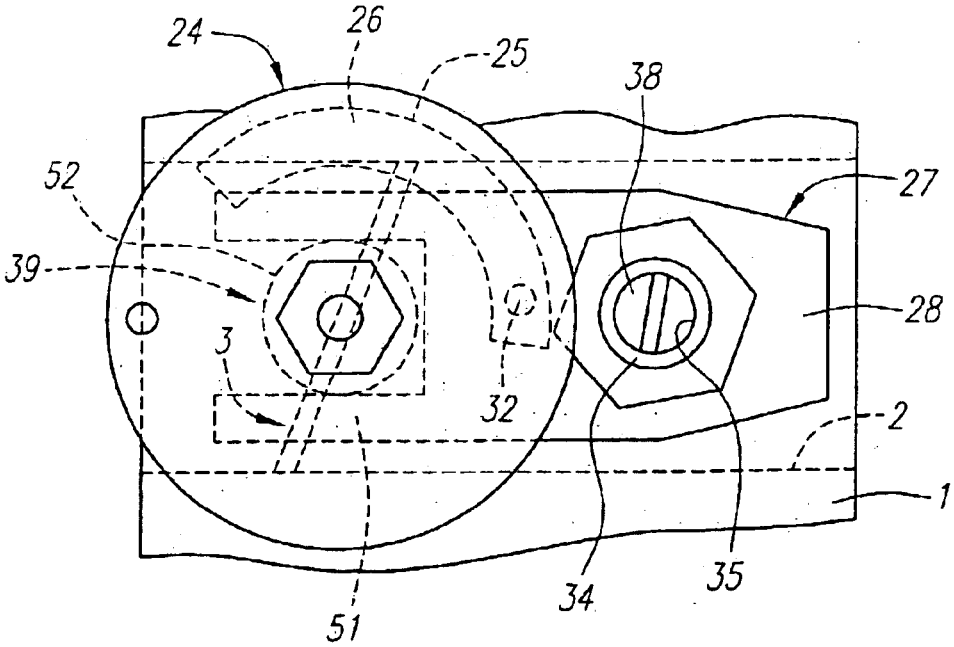
FIG. 3 is a longitudinal sectional view of the second embodiment of a carburetor of the present invention.
Figure 4:
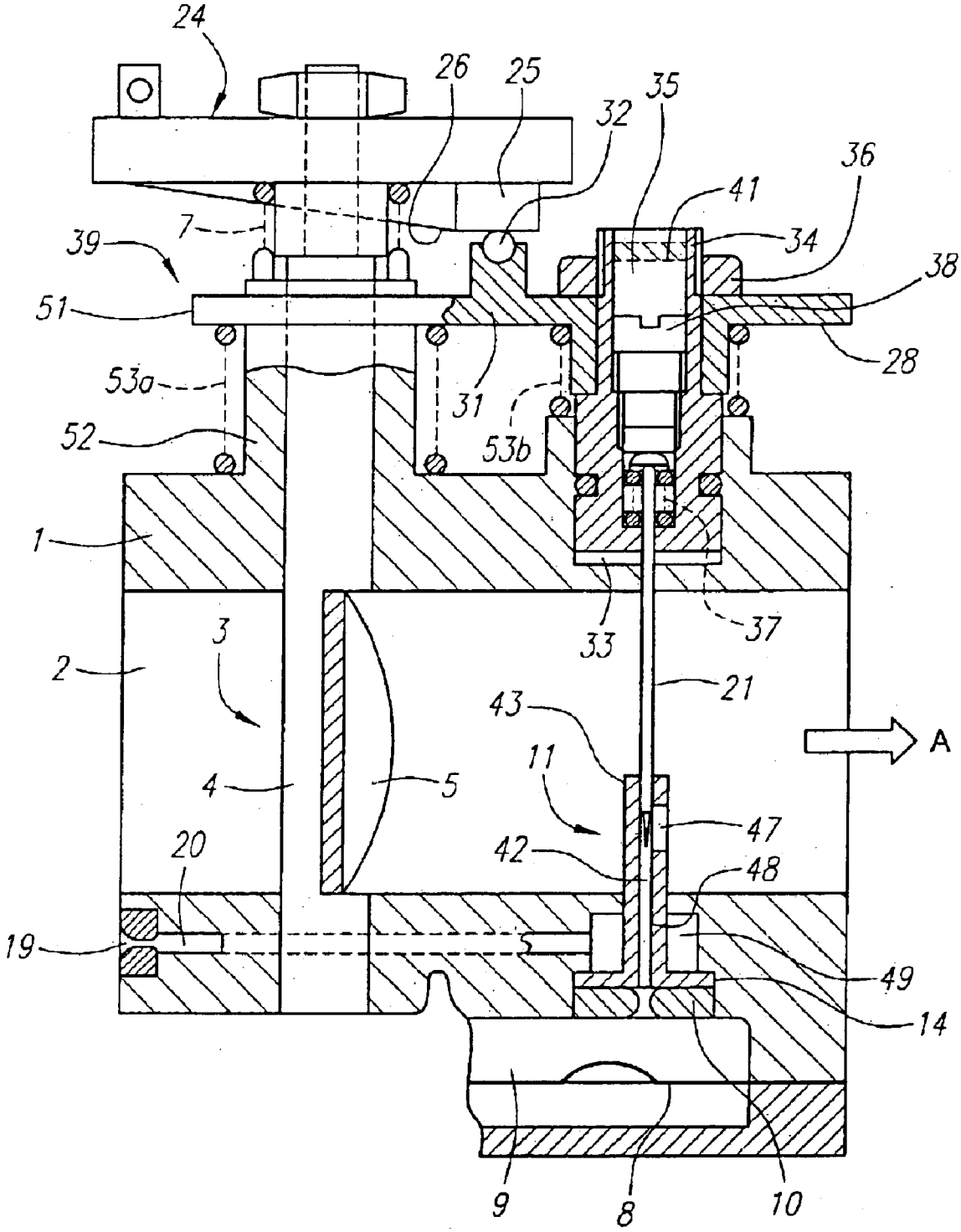
FIG. 4 is a top view of the carburetor shown in FIG. 3.

Next, FIGS. 3 and 4 show a second preferred embodiment of the present invention. Aspects of this embodiment identical to those of the first embodiment are as follows: the butterfly-type throttle valve 3, which opens and closes the air intake pathway 2 that is formed in the body 1 and has a uniform diameter along its entire length; the constant fuel chamber 9 that holds a constant amount of fuel by means of the diaphragm 8; the cam member 24, which comprises an arc-shaped cam 25 with d cam face 26 that is centered on the valve stem 4, and faces the body 1, is secured to an end of the valve stem 4 of the throttle valve 3; the actuating member 7, which comprises the planar following member 28 that has the contact member 32 and the cylindrical retaining member 34; and the metering pin 21, which extends across the air intake pathway 2.

Similarly, an end of the metering pin 21 is inserted into the control hole 35 from a tip of the retaining member 34, which is inserted into the retaining hole 33, and a biasing force in the direction of insertion is provided by the spring 37. In addition, the tip of the adjustment screw 38, inserted and screwed from the base end side into the control hole 35, makes contact with the tip of the metering pin 21, just as it does in the first embodiment.

The fuel nozzle 11 of this embodiment, which is positioned adjacent to the main jet 10, comprises a pipe 43 with a hole 42 passing through the entire fuel nozzle 11. The pipe 43 has a pressing flange 14 on the base end thereof that is superimposed on the main jet 10, a nozzle port 47 elongated in the axial direction on the peripheral side surface of the tip portion thereof, and one or a plurality of air bleeding holes 48 on the peripheral side surface of the base end thereof. The pipe protrudes in to the air intake pathway 2 downstream of the throttle valve 3, and the tip of the metering pin 21 is inserted into the hole 42. A toric air chamber 49 is provided in the outer area of the air bleeding hole 48. A bled air pathway 20 with a jet 19 for controlling air flow is connected to an air chamber 49.

Fuel entering the hole 42 from the constant fuel chamber 9 via the main jet 10 mixes with bled air entering from the air bleeding hole 48 and is sent to the air intake pathway 2 from the nozzle port 47. The amount of fuel sent is controlled according to changes in the effective aperture area of the nozzle port 47 by the metering pin 21.

The following member 28 of the actuating member 27 is arranged along the surface of the side of the body 1 to which the cam member 24 is disposed, as is the case in the first embodiment. A forked member 51 formed on one end thereof is fit with a minimal gap to a boss 52 of the valve stem 4. The retaining member 34 is joined and secured to the opposite end and sandwiches the platform 31, with the middle contact portion 32, between it and the forked member 51.

The boss 52 makes contact with three sides of the forked member 51. The boss 52 and the forked member 51 constitute a rotation baffling means 39, which causes the retaining member 34 to reciprocate linearly along the same axis on which the fuel nozzle 11 and the metering pin 21 move while preventing displacement of the following member 28. Pressing springs 53A and 53B comprising pressure coil springs respectively sandwich the boss 52 and the retaining member 34 and are inserted between the body 1 and the following member 28. The pressing springs 53A and 53B continually press the contact portion 32 into contact with the cam face 26, cause the actuating member 27 to move parallel without tilting, and provide the accurate metering of fuel by the metering pin 21.

In this embodiment as well, the retaining member 34 is arranged on the outside area of the cam member 24, so the depth of insertion of the metering pin 21 into the hole 12 during idling in particular (i.e., the area of the effective aperture of the nozzle port 47) can be adjusted to bring about stable idling. Once adjustment is complete, a plug 41 is easily inserted to close the end of the control hole 35.

In this embodiment, the valve stem 4 does not also serve as a throttle valve lever for transmitting the acceleration control. Instead, the cam member 24 is made to take on the function of the throttle valve lever. In addition, the return spring 7 is disposed between the cam member 24 and the boss 52. This facilitates a reduction in the number of parts and makes it possible to avoid increasing the size of the entire carburetor.

In this embodiment as well, the flow rate characteristic of the fuel can be set arbitrarily by the shape of the cam, the size and shape of the nozzle port 47, and, in particular, the shape of the tip of the metering pin 21. The stroke of the metering pin 21 may be set as desired with the cam 25 irrespective of the opening and closing of the throttle valve 3, and the position of the metering pin 21 relative to the fuel nozzle 11 can be adjusted with the adjustment screw 38, thereby eliminating design and manufacturing problems and paving the way for downscaling the size of the carburetor as a whole. This effect is similar to that provided by the first embodiment.

In accordance with the present invention, as was described above, the amount of fuel supplied from a fuel nozzle of a single fuel system disposed downstream of the throttle valve of an air intake pathway with a nearly uniform diameter along its entire length, is controlled over the entire operation range of an engine by converting the opening and closing motion of a butterfly throttle valve into linear reciprocal movement of a metering pin. Therefore, with the present invention it is possible to increase the output, to optimize the fuel flow rate, to decrease the size of the entire carburetor, to facilitate design and manufacture, and to obtain a carburetor with excellent performance.

While various preferred embodiments of the invention have been shown for purposes of illustration, it will be understood that those skilled in the art may make modifications thereof without departing from the true scope of the invention as set forth in the appended claims including equivalents thereof.

What is claimed is:

1. A carburetor comprising an air intake pathway having a nearly uniform diameter along its entire length, a butterfly throttle valve that opens and closes the air intake pathway, a metering pin having a tip thereof inserted into a fuel nozzle opening into the air intake pathway, and a fuel control member linearly reciprocating the metering pin in response to the opening and closing operation of the throttle valve, the fuel control member having an actuating member that reciprocates linearly.

2. The carburetor of claim 1 wherein the fuel control member further comprises a cam member coupled to a valve stem of the throttle valve, wherein the actuating member is operably coupled to the cam member, the metering pin is coupled to the actuating member and reciprocates linearly following the opening and closing operation of the throttle valve to control the amount of fuel supplied from the fuel nozzle to the air intake pathway.

3. The carburetor of claim 2 wherein the cam member comprises an arc-shaped cam face and wherein the actuating member makes constant contact with the cam face.

4. The carburetor of claim 2, wherein the actuating member has a metering pin retaining member.

5. The carburetor of claim 3, wherein the actuating member has a contact portion in contact with the cam face.

6. The carburetor of claim 5, wherein the contact portion is supported on a body of the carburetor by a rotation locking means.

7. The carburetor of claim 5, wherein the contact portion is biased against the cam face under the force of a spring.

8. The carburetor of claim 4, wherein the retaining member has an open-ended, tube shape and is disposed in a region on the outside of the cam member.

9. The carburetor of claim 8, further comprising an adjustment screw screwed into the inside of the retaining member to adjust the insertion depth of the metering pin into the fuel nozzle.

10. The carburetor of claim 2, wherein the actuating member has a contact portion and comprises a following member arranged along the surface of the side of a body of the carburetor on the side where the cam member is disposed.

11. The carburetor of claim 10, wherein the actuating member has a retaining member, which is secured to the following member and is received in a retaining hole provided in the body.

12. The carburetor of claim 11, wherein the actuating member further comprises a rotation locking means.

13. The carburetor of claim 12, wherein the rotation locking means includes legs provided on both ends of the following member and inserted into receiving holes provided in the body.

14. The carburetor of claim 12, wherein the rotation locking means includes a forked member formed on one end of the following member and coupled with a minimal gap to a boss of the valve stem.

15. The carburetor of claim 4, wherein the end of the retaining member is sealed with a plug.

16. The carburetor of claim 2, wherein the cam member serves as a throttle lever attached to the valve stem so that acceleration control is transmitted to and opens or closes the throttle valve.

17. A fuel control member for carburetor having an air intake pathway and a butterfly throttle valve, comprising a cam member couplable to a valve stem of a throttle valve of a carburetor, and an actuating member operably coupled to the cam member and a metering pin, the actuating member reciprocates linearly following the opening and closing operation of a throttle valve of a carburetor to control the amount of fuel supplied from a fuel nozzle to an air intake pathway.

18. The carburetor of claim 17 wherein the cam member comprises an arc-shaped cam face and wherein the actuating member makes constant contact with the cam face.

19. The carburetor of claim 17, wherein the actuating member has a metering pin retaining member.

20. The carburetor of claim 18, wherein the actuating member has a contact portion in contact with the cam face.

21. The carburetor of claim 20, wherein the contact portion is supportable on a body of a carburetor by a rotation locking means.

22. The carburetor of claim 20, wherein the contact portion is biased against the cam face under the force of a spring.

23. The carburetor of claim 19, wherein the retaining member has an open-ended, tube shape and is disposed in a region on the outside of the cam member.

24. The carburetor of claim 23, further comprising an adjustment screw screwed into the inside of the retaining member to adjust the insertion depth of the metering pin into the fuel nozzle.

25. The carburetor of claim 17, wherein the actuating member has a contact portion and comprises a following member positionable along the surface of a side of a body of a carburetor where the cam member is disposed.

26. The carburetor of claim 25, wherein the actuating member has a retaining member, which is secured to the following member and is receivable in a retaining hole provided in a body of a carburetor.

27. The carburetor of claim 26, wherein the actuating member further comprises a rotation locking means.

28. The carburetor of claim 27, wherein the rotation locking means includes legs provided on both ends of the following member and inserted into receiving holes provided in a body of a carburetor.

29. The carburetor of claim 27, wherein the rotation locking means includes a forked member formed on one end of the following member and coupled with a minimal gap to a boss of a valve stem of a throttle valve of a carburetor.

30. A carburetor comprising an air intake pathway having a nearly uniform diameter along its entire length, a butterfly throttle valve that opens and closes the air intake pathway, a metering pin having a tip thereof inserted into a fuel nozzle opening into the air intake pathway, and a fuel control member linearly reciprocating the metering pin in response to the opening and closing operation of the throttle valve, the fuel control member having a cam member coupled to a valve stem of the throttle valve, and an actuating member having a contact portion and having a following member arranged along the surface of the side of a body of the carburetor on the side where the cam member is disposed, the actuating member being operably coupled to the cam member, the metering pin is coupled to the actuating member and reciprocates linearly following the opening and closing operation of the throttle valve to control the amount of fuel supplied from the fuel nozzle to the air intake pathway, wherein the actuating member has a retaining member, which is secured to the following member and is received in a retaining hole provided in the body, wherein the actuating member further comprises a rotation locking means, wherein the rotation locking means includes legs provided on both ends of the following member and inserted into receiving holes provided in the body.

31. A carburetor comprising an air intake pathway having a nearly uniform diameter along its entire length, a butterfly throttle valve that opens and closes the air intake pathway, a metering pin having a tip thereof inserted into a fuel nozzle opening into the air intake pathway, and a fuel control member linearly reciprocating the metering pin in response to the opening and closing operation of the throttle valve, the fuel control member having a cam member coupled to a valve stem of the throttle valve, and an actuating member having a contact portion and having a following member arranged along the surface of the side of a body of the carburetor on the side where the cam member is disposed, the actuating member being operably coupled to the cam member, the metering pin is coupled to the actuating member and reciprocates linearly following the opening and closing operation of the throttle valve to control the amount of fuel supplied from the fuel nozzle to the air intake pathway, wherein the actuating member has a retaining member, which is secured to the following member and is received in a retaining hole provided in the body, wherein the actuating member further comprises a rotation locking means, wherein the rotation locking means includes a forked member formed on one end of the following member and coupled with a minimal gap to a boss of the valve stem.

* * * * *